US005949028A

United States Patent [19]

Verfurth et al.

[11] Patent Number: 5,949,028

[45] Date of Patent: Sep. 7, 1999

[54] INSULATOR ASSEMBLY FOR A HIGH VOLTAGE POWER SUPPLY WIRE

[75] Inventors: Ronald S. Verfurth, Pekin, Ill.; Raul G. Flores, Yukon, Okla.

[73] Assignee: NewWave Innovations, Inc., Springfield, Mo.

[21] Appl. No.: 08/919,873

[22] Filed: Aug. 28, 1997

Related U.S. Application Data

[60] Provisional application No. 60/024,599, Aug. 29, 1996.

[51] Int. Cl.[6] ..... H01B 17/14

[52] U.S. Cl. ..... 174/158 R; 174/167; 174/174

[58] Field of Search ..... 174/158 R, 152 R, 174/152 G, 153 G, 154, 157, 167, 168, 174

[56] References Cited

U.S. PATENT DOCUMENTS

| | | | |
|---|---|---|---|
| 3,825,320 | 7/1974 | Redfern | 174/152 R |
| 4,168,394 | 9/1979 | Yuey | 174/151 |
| 4,492,817 | 1/1985 | Selby | 174/152 R |
| 5,227,587 | 7/1993 | Paterek | 174/152 R |

FOREIGN PATENT DOCUMENTS

| | | | |
|---|---|---|---|
| 860518 | 1/1941 | France | 174/152 |
| 873697 | 4/1942 | France | 174/151 |
| 446102 | 4/1936 | United Kingdom | 174/151 |

*Primary Examiner*—Nestor Ramirez
*Assistant Examiner*—Joseph Waks
*Attorney, Agent, or Firm*—Crowe & Dunlevy

[57] ABSTRACT

An apparatus for electrically insulating and supporting a power supply wire relative to a substantially planar boundary, is disclosed. A translucent insulator is formed from a supercooled, nonporous igneous magma, such as glass, and includes a head and a shank extending from the head, the shank extendable through an opening in the boundary. The head and the shank form an annular passageway for receiving disposition of the wire. A shoulder surface limits the extension of the shank through the boundary opening and a retaining member, such as a nut, engages corresponding features of the shank to secure the insulator relative to the boundary. A seal can be additionally provided to engage the head and the wire to further seal the insulator.

18 Claims, 2 Drawing Sheets

INSULATOR ASSEMBLY FOR A HIGH VOLTAGE POWER SUPPLY WIRE

CROSS-REFERENCE TO RELATED APPLICATIONS

This application clams priority to U.S. Provisional Application Serial No. 60/024,599 filed Aug. 29, 1996, hereby incorporated by reference.

BACKGROUND OF THE INVENTION

The present invention relates generally to the field of electrically insulative devices, and more particularly, but not by way of limitation, to an improved insulator for the disposal of high voltage power supply wires used in commercial electrical signs.

Electrical signs used commercially to advertise a business or event typically require high voltage power supply wires to transfer electrical power from a power distribution source to the point of power termination within the sign. Neon signs in particular commonly employ step-up transformers that generate secondary side voltages in the range of five to fifteen thousand volts. With such relatively high secondary side voltages, wires have commonly been found to prematurely fail over time, causing a short circuiting of the supply power to the sign enclosure. These electrical failures can create a dangerous safety hazard to personnel working in and around the sign and can initiate an electrical fire resulting in the catastrophic loss of property and lives.

Such failures usually stem from a breakdown of insulation between the wire's conductors and a grounded conductive portion of the sign. Although the power supply wires typically employ the use of an insulative sheath, the sheath alone commonly does not provide reliable protection when subjected to the harsh and continuous duty operation conditions characteristic of a high voltage sign.

In a commercial sign the power supply wire is generally passed through an opening in a substantially planar boundary, such as through a wall of an enclosure (sometimes referred to as a can), which is typically made of a conductive material such as aluminum or sheet metal. The boundary may also comprise a facia of a sign or a structural member such as plywood, sheetrock, concrete and the like.

Insulators of various types have been employed to electrically insulate the wire from the boundary to prevent short circuiting and failure of the wire. Such insulators have been fabricated using well known electrically insulative materials such as rubber, plastic, and the like. No insulator has been found to date, however, that will consistently and reliably prevent premature short circuit failures.

One solution commonly employed by those skilled in the art to minimize electrical shorting is to fabricate an insulator for the wires for a glass slip stick comprising a hollow, cylindrical member. To do so, an operator passes the wire through the slip stick and secures the slip stick in the boundary opening using a suitable caulking material, such as silicon.

Although the use of slip sticks has been found to provide improved electrical insulation for wires in a commercial sign application, limitations are associated with this approach. First, the process of installing the slip sticks is labor and material intensive, especially for large signs which may require the fabrication of tens, or even hundreds of such hand-crafted insulators.

Second, there is a risk of injury to the operator through the handling of the slip sticks, should one be inadvertently broken during installation. Third, the resulting insulator can distract from the cosmetic appearance of the sign, especially when the insulators are visible when a passerby views the sign. Finally, the process does not completely prevent failure, as over time the caulking materials can adsorb moisture or dry out and crack, leading to an eventual failure of the sign.

Accordingly, there is a need for an improved approach to insulating high voltage wires in a commercial sign application that is easily installed, cosmetically appealing, and reliable in operation.

SUMMARY OF THE INVENTION

The present invention provides an improved insulator apparatus for the support and electrical insulation of high voltage electrical wires passed through an electrically conductive boundary, such as in a commercial electrical sign.

In accordance with the preferred embodiment, an insulator is formed from a supercooled, nonporous igneous magma, such as glass. The insulator has a longitudinal annular passageway through which the high voltage supply wire is disposed and is supportable within an opening in the boundary to insulate the wire from the boundary in all radial directions.

The insulator has a shank that is cross-sectionally smaller than the boundary opening and is thereby extendable through the opening. A head connected to the shank is cross-sectionally larger than the boundary opening and includes a shoulder surface which pressingly abuts the boundary to limit the extension of the shank tough the opening. A retaining member engages features of the shank and pressingly engages the boundary in opposition to the shoulder surface, thereby cooperating with the shoulder surface to support the insulator relative to the boundary.

Preferably, the shank includes an external screw thread and the retaining member comprises a backing nut which threadingly advances upon the external screw thread.

A weatherproof seal is additionally provided as desired to form an insulator assembly which reduces the ingress of environmental elements such as moisture and contaminants. The seal is formed with a ring portion at a first end which supportingly engages a mating groove on the head of the insulator so that the seal can be installed or removed without removing the insulator from the boundary. The seal forms an annular passageway at a distal end for receiving the wire and providing a weatherproof seal thereagainst.

These and other features as well as advantages which characterize the present invention will be apparent from a reading of the following detailed description and a review of the associated drawings.

DETAILED DESCRIPTIONS

Figure 1:
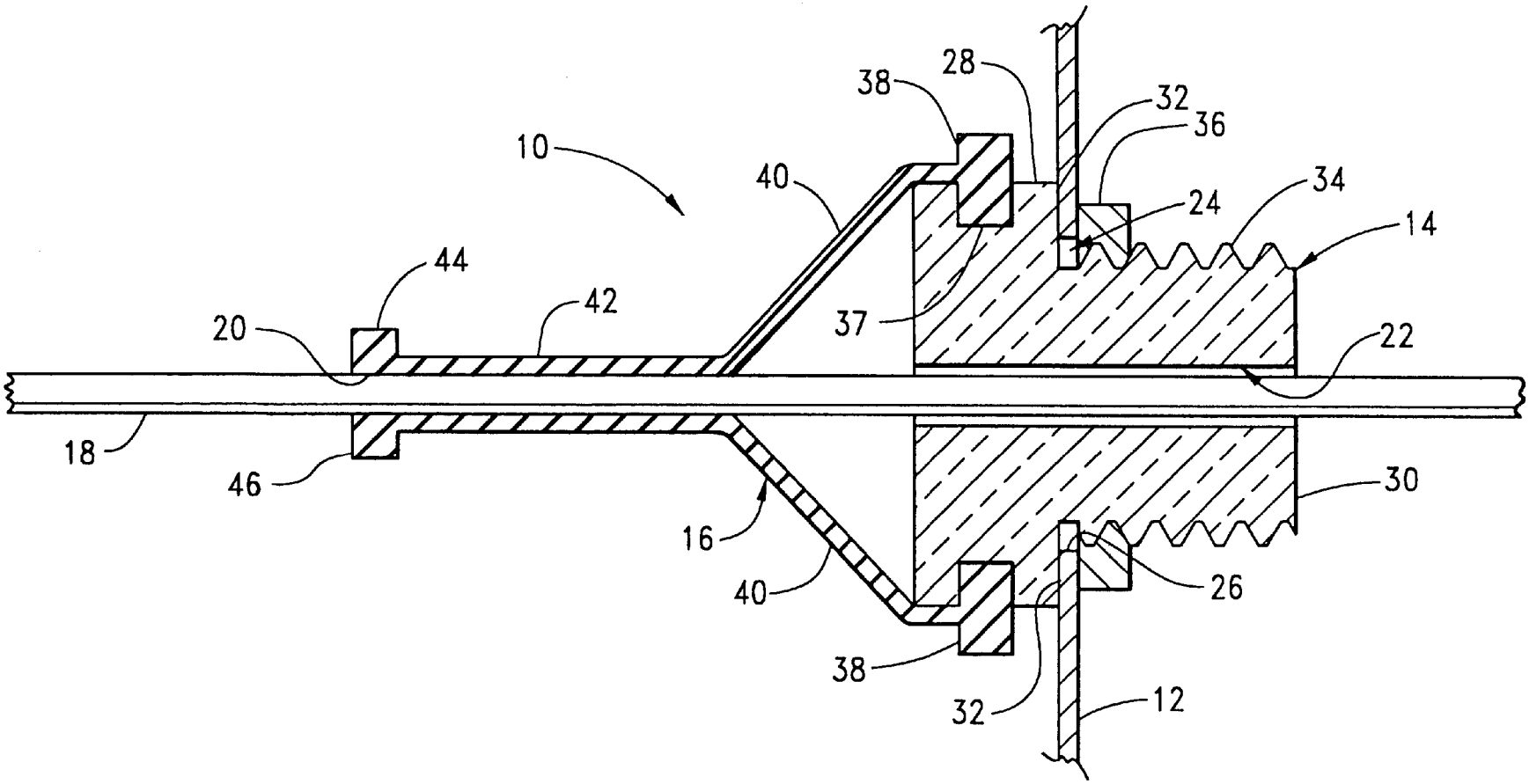
FIG. 1 is a partial cross-sectional representation of an insulator assembly constructed in accordance with the preferred embodiment of the present invention, the insulator assembly supported in an opening of a boundary.

Referring to the drawings in general and in particular to FIG. 1, shown therein is a cross-sectional, elevational view of an electrical insulator assembly 10 shown in an installed state with respect to an electrically conductive, substantially planar boundary, which is contemplated as comprising a portion of a enclosure 12 housing an electrical device, such as a transformer (not shown). However, it will be recognized that the boundary could also readily represent a facia portion of a commercial sign or other structural barrier. The insulator assembly 10 generally comprises an insulator 14 and a resilient seal 16. An electrical wire 18 passes though an annular passageway 20 formed by the seal 16, and also through a coextensive annular passageway 22 formed in the insulator 14.

The enclosure 12 is constructed of a conductive material such as aluminum or sheet metal. An opening 24 is provided in the enclosure to allow passage of the wire 18 from an external power source (not shown) to the device's point of power termination (not shown) contained within the enclosure 12. In practice, the opening 24 will usually have a sharp edge 26.

Those skilled in the art will recognize the importance of electrically insulating the wire 18 from the electrically conductive enclosure 12 to prevent electrical discharge, or short circuiting, between the wire 18 and the enclosure 12. Typically the wire 18 will include an outer insulative sheath (not separately designated) for electrical insulation purposes, but it will be recognized that the sheath in and of itself is insufficient to prevent a short circuit if the wire 18 contacts the edge 26 of the enclosure opening 24. Furthermore, it will be understood that where the wire 18 carries high voltage power, additional insulation will be necessary to prevent premature breakdown of the sheath where the wire 18 passes through a conductive support.

Turning now to the support of the insulator 14 by the enclosure 12, it will be noted that the insulator 14 includes a head 28 and a shank 30, with the head 30 having a larger cross-sectional diameter than that of the shank 30. Medially, a shoulder surface 32 is formed which is substantially parallel to the enclosure 12 in the area proximate the opening 24. In an installed state the shoulder 32 abuttingly engages the enclosure 12, limiting the extension of the shank 30 through the opening 24.

In the preferred embodiment of FIG. 1 it will be noted that a continuous external screw thread 34 is formed on the shank 30. A retaining member comprising a backing nut 36 has an internal screw thread (not separately designated) which matingly engages the thread 34, allowing the nut 36 to be threadingly advanced toward the enclosure 12. The backing nut 36 is advanced until it engages the enclosure 12, and thereafter further advanced to pressingly engage the enclosure 12 in opposition to the shoulder 32 on the opposing side of the enclosure 12. In this manner, tightening of the nut 36 provides support to the insulator 14 by the opposing pressing engagement of the shoulder 32 and the nut 36.

It will be apparent that methods other than the thread 34 and nut 36 may be employed to secure the insulator 14 with in the enclosure 12. For example, a smooth or barbed shank may be used in conjunction with a retaining member comprising a push-on retaining clip to achieve similar results. One advantage of the configuration of FIG. 1, however is that the nut 36 can be readily removed and then subsequently replaced. Another advantage is the ability to adjust the retaining force by selecting the torque imparted to the nut 36. Yet another advantage is that the thread 34 can be sized to mate with conduit commonly used to route electrical wires inside buildings. Hence, as desired the insulator 14 can be screwed into mating conduit hardware and the wire 18 can pass through the insulator 14 and into the conduit.

It will be noted that FIG. 1 shows the insulator 14 to be unitarily formed so that no sections exist creating joints therebetween. Such a joint would adversely create an uninsulated path for an electrical short circuit between the wire 18 and the enclosure 12.

The insulator 14 is preferably formed from a nonporous, nonconductive, noncrystalline material to optimize its insulative characteristics to withstand deleterious environmental effects such as sunlight and temperature variations, as well as the effects of electrical flux energy forces and heat generated by the voltage on the wire 18. More particularly, the insulator 14 is formed from a supercooled, nonporous igneous magma, such as glass, using a conventional high pressure,injection molding process. Glass provides superior electrical insulation characteristics as compared to other well known insulation materials, such as rubber, plastic, cork and the like. The superiority of glass is due to its homogenous, nonporous amorphous constituency and its superior resistance to the adverse internal and external decaying effects described above. An insulator made of rubber, for instance, will typically become brittle with time when subjected to these conditions, resulting in an increased likelihood that a pin hole or fault crack will develop, providing a short circuit path through the rubber insulator.

Other rigid, noncrystalline materials like ceramics have also been used in the fabrication of various insulator configurations. As will be recognized, ceramics are formed by firing nonmetallic earthy materials (clay, bauxite, etc.) at a high temperature. Unlike glass, however, ceramics are relatively porous and as such have a tendency to adsorb moisture and break down over time. To reduce these deleterious effects, ceramics typically include a glazing operation to reduce surface porosity. However, such glazing tends to degrade when subjected to heat and electrical fields established by high voltages on the wires proximate to such ceramic insulators; moreover, such glazing is often applied only to portions of the surface of these insulators.

Finally, making the insulator 14 of glass provides the additional benefit of a transparent component which is thus substantially invisible from an appreciable distance. This feature is advantageous where the insulator is used in an electric sign, where the insulator's translucent character will assume the color of the sign to which it is attached, thus providing an aesthetically pleasing effect. Of course, the glass can also be colored as desired through the introduction of appropriate materials (such as cobalt to create a blue glass insulator).

It is often desirable to seal the enclosure opening around the wire 18, where moisture or environmental conditions are harmful to the device's components within the enclosure 12, To meet this need the insulator 4 can be used in combination with the seal 16 shown in FIG. 1.

Figure 2:
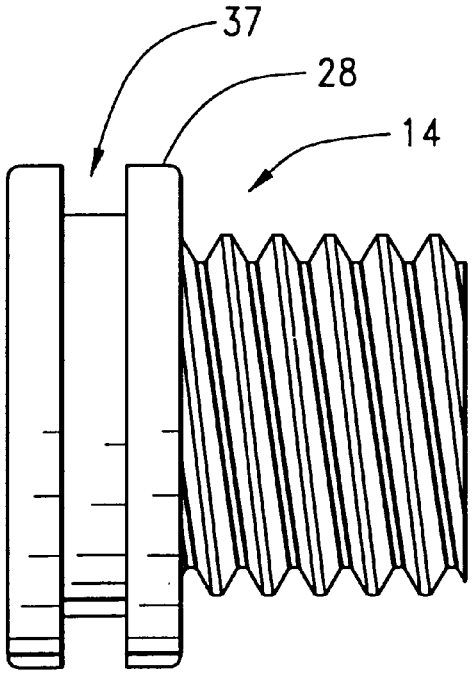
FIG. 2 is an elevational view of the insulator of FIG. 1
Figure 3:
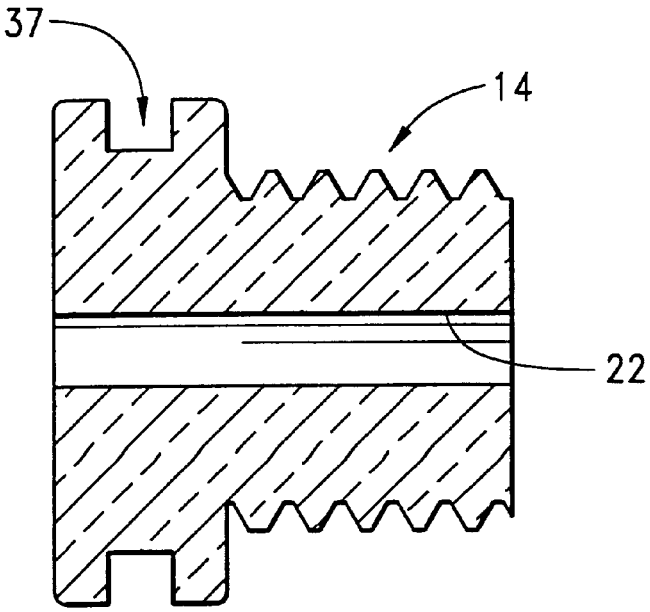
FIG. 3 is a cross-sectional view of the insulator of FIG. 2.

Referring now to FIG. 2, to accommodate the seal 16 a peripheral groove 37 is formed within the head 28 of the insulator 14. FIG. 3 shows that the groove 37 does not intersect, and is thereby electrically insulated from, the annular passageway 22 through which the electrical wire 18 passes. Returning to FIG. 1, the seal 16 includes a ring 38 which matingly engages and substantially fills the groove 37 of the insulator 14. A transitioning portion 40 depends from the ring 38, which in turn supports a sealing portion 42. The sealing portion 42 is marginally smaller than the cross-sectional size of the wire 18 so that the sealing portion 42 presses against the wire 18, providing a fluid-tight seal therebetween. A stiffener ring 44 can further be provided at a distal end of the sealing portion 42 to locally increase the pressure against the wire 18 at a lading edge 46 of the sealing portion 42.

It will be noted that the seal 16 can be installed on the insulator 14, or removed therefrom, by the engagement or disengagement of the ring portion 38 from the groove 37. As such, it is possible to install or remove the seal 16 with the insulator 14 intact within the enclosure 12.

From the foregoing discussion it will be recognized that the present invention provides an apparatus for supporting and insulating an electrical power supply wire (such as 18) relative to a substantially planar boundary (such as the enclosure 12).

More particularly, an insulator (such as 14) is formed as a supercooled, nonporous igneous magma having a head (such as 28), a shank (such as 30) depending from the head and a shoulder (such as 32) disposed between the head and the shank, the shoulder limiting extension of the shank through an opening (such as 24) through the boundary. An annular passageway (such as 22) is formed through the head and the shank for receiving disposition of the wire.

A retaining member (such as the nut 36) cooperates with features of the shank (such as threads 34) to retain the insulator relative to the boundary. A seal (such as 16) can additionally be provided to engage the isolator and the wire to further seal the isolator.

For purposes of the appended claims, the phrase "supercooled, nonporous igneous magma" will be understood as used by those skilled in the art as an amorphous, inorganic substance comprising silicates, borates and/or phosphates formed by a fusion of silica or oxides of boron or phosphorus with a flux and stabilizer into a mass that cools to a rigid, noncrystallized condition, such as glass including quartz glass and silica glass.

It is clear that the present invention is well adapted to attain the ends and advantages mentioned as well as those inherent therein. While a presently preferred embodiment of the invention has been described for purposes of the disclosure, it will be understood that numerous changes may be made which will readily suggest themselves to those skilled in the art and which are encompassed within the spirit of the invention disclosed and as defined in the appended claims.

What is claimed is:

1. An insulator for supporting and insulating an electrical power supply wire relative to a substantially planar boundary, comprising:

a head formed at a first end of the insulator through which an annular passageway extends for receiving disposition of the wire;

a shank depending from the head, the shank extendable through an opening in the boundary, wherein the annular passageway extends through the shank; and a shoulder surface formed between the head and the shank, the shoulder surface abuttable with a first surface of the boundary through which the opening in the boundary extends, the shoulder surface preventing extension of the head into the opening in the boundary;

wherein the head, the shank and the shoulder are formed from a supercooled, nonporous igneous magma, and wherein the head is characterized as translucent.

2. The insulator of claim 1, wherein the shank further includes a feature accommodating the use of retaining means for retaining the insulator relative to the boundary by a pressing engagement of the retaining means against a second surface of the boundary in opposition to an abutting engagement of the shoulder with the first surface of the boundary.

3. The insulator of claim 2, wherein the feature of the shank comprises a threaded portion and the retaining means comprises a nut engageable with the threaded portion.

4. The insulator of claim 1, wherein the insulator comprises glass.

5. The insulator of claim 1, wherein the head further comprises a radially extending, outer surface having a diameter greater than an outer diameter of the shank, the outer surface having a circumferentially extending groove.

6. The insulator of claim 5, in combination with a seal assembly engageable with the insulator to seal the insulator from external moisture and contaminants, the seal assembly comprising:

a ring portion engageable with the groove to interconnect the seal assembly and the insulator;

a seal body extending from the ring portion, the seal body defining an interior volume accommodating a portion of the wire; and a sealing end connected to the seal body opposite the ring portion, the sealing end forming a passageway for receiving disposition of the electrical wire, wherein the sealing end contacts the wire to form a moisture resistant seal.

7. The insulator of claim 6, wherein the passageway of the sealing end has a diameter smaller than a diameter of the wire to facilitate the formation of the moisture resistant seal.

8. An insulator assembly for supporting and electrically insulating a power supply wire for an electrical device, wherein the wire passes through a portion of a substantially planar boundary, wherein the insulator is supported by the boundary and cooperates with an opening therein to electrically insulate the wire from the boundary, the insulator assembly comprising:

a translucent insulator formed of a supercooled, nonporous igneous magma and comprising:

a head formed at a first end through which an annular passageway extends for receiving disposition of the wire;

a shank depending from the head, the shank extending through the opening in the boundary, wherein the annular passageway extends through the shank so that the wire passes through the head and the shank; and a shoulder surface formed between the head and the shank, the shoulder surface abutting a first surface of the boundary through which the opening in the boundary extends, the shoulder surface preventing extension of the head into the opening in the boundary; and retaining means, connected to the shank, for retaining the insulator relative to the boundary by a pressing engagement of the retaining means against a second surface of the boundary in opposition to the abutting of the shoulder with the first surface of the boundary.

9. The insulator assembly of claim 8, wherein the shank further comprises a threaded portion and the retaining means comprises a nut engageable with the threaded portion.

10. The insulator assembly of claim 8, wherein the insulator comprises glass.

11. The insulator assembly of claim 8, wherein the head further comprises a radially extending, outer surface having a diameter greater than an outer diameter of the shank, the outer surface having a circumferentially extending groove.

12. The insulator assembly of claim 11, further comprising a seal assembly engageable with the insulator to seal the insulator from external moisture and contaminants, the seal assembly comprising:

a ring portion engaging the groove to interconnect the seal assembly and the insulator;

a seal body extending from the ring portion, the seal body defining an interior volume accommodating a portion of the wire; and a sealing end connected to the seal body opposite the ring portion, the sealing end forming a passageway for receiving disposition of the electrical wire, wherein the sealing end contacts the wire to form a moisture resistant seal.

13. The insulator of claim 12, wherein the passageway of the sealing end has a diameter smaller than a diameter of the wire to facilitate the formation of the moisture resistant seal.

14. An insulator for providing electrical insulation between a conductor and a conductive planar boundary through which conductor extends, the boundary having a first planar surface, a second planar surface opposite the first planar surface and an aperture extending through the boundary front the first planar surface to the second planar surface, the insulator disposable within the aperture, the insulator comprising:

a cylindrically shaped, translucent head having a top surface, a shoulder surface opposite the top surface and a circumferentially extending outer surface at a radius greater than a radius of the aperture, the shoulder surface nominally parallel with the top surface, nominally perpendicular with the outer surface and abuttable with the first planar surface of the boundary to prevent extension of the head into the aperture;

a cylindrically shaped shank extending from the shoulder surface in a direction generally normal to the shoulder surface, the shank having a radius less than the radius of the aperture and a length greater than a length of the aperture so that a distal end of the shank projects beyond the second planar surface of the boundary when the shoulder surface abuts the first planar surface of the boundary; and a fastener connectable to the distal end of the shank and pressingly engageable against the second planar surface to secure the insulator relative to the boundary;

wherein the head and the shank include an annular passageway which extends from the top surface of the head to the distal end of the shank to accommodate passage of the conductor through the insulator so that the head and the shank are disposed between the conductor and the boundary; and wherein the head and the shank are formed from a supercooled, nonporous igneous magma.

15. The insulator of claim 14, in combination with a resilient seal assembly engageable with the outer surface of the head, the seal assembly comprising:

a ring portion abuttable with the outer surface to interconnect the seal assembly and the insulator;

a seal body connected to and extending from the ring portion in a direction away from the first planar boundary and defining an interior volume to accommodate a portion of the conductor; and a sealing end connected to the seal body abuttable with the conductor.

16. The insulator of claim 15, wherein the radius of the outer surface of the head comprises a first radius, wherein the outer surface of the head includes a groove having a groove radius less than the first radius, and wherein the ring portion engages the groove.

17. The insulator of claim 14, wherein the shank comprises a plurality of threads and the fastener comprises a nut engageable with the plurality of threads.

18. The insulator of claim 14, wherein the insulator comprises glass.

* * * * *